US005812423A

United States Patent [19]

Maisotsenko et al.

[11] Patent Number: 5,812,423

[45] Date of Patent: Sep. 22, 1998

[54] METHOD OF DETERMINING WORKING MEDIA MOTION AND DESIGNING FLOW STRUCTURES FOR SAME

[75] Inventors: Valeriy S. Maisotsenko, 5628 S. Idalia St., Aurora, Colo. 80015; Vassili A. Arsiri, Odessa, Ukraine

[73] Assignee: Valeriy S. Maisotsenko, Aurora, Colo.

[21] Appl. No.: 635,966

[22] PCT Filed: Oct. 28, 1994

[86] PCT No.: PCT/US94/12479

§ 371 Date: Apr. 29, 1996

§ 102(e) Date: Apr. 29, 1996

[87] PCT Pub. No.: WO95/12160

PCT Pub. Date: May 4, 1995

Related U.S. Application Data

[63] Continuation-in-part of Ser. No. 144,776, Oct. 28, 1993, abandoned.

[51] Int. Cl.[6] ..... G06G 7/50

[52] U.S. Cl. ..... 364/512; 137/1; 137/2; 137/10

[58] Field of Search ..... 364/512, 578; 137/1–14

[56] References Cited

U.S. PATENT DOCUMENTS 4,660,587 4/1987 Rizzie ..... 137/8

5,074,324 12/1991 Ng ..... 137/13

*Primary Examiner*—Kevin J. Teska
*Assistant Examiner*—A. S. Roberts
*Attorney, Agent, or Firm*—Sheridan Ross P.C.

[57] ABSTRACT

The working media, e.g., fluid or gaseous will be motioned in a restricted space, e.g., in a piping by adding velocity to the same. While prior to the working media motion the wavelength of the motioned working media dynamic processes will be calculated then the working media will be supplied into the restricted space the characteristic diameters of which in the characteristic sections will be calculated depending on the motioned working media wavelength. When utilizing the proposed method of working media motion to achieve the maximum possible decrease of the resistance the value of characteristic diameter in the characteristic section of the restricted space will be calculated by the formula: $d_1=n\times\lambda+\frac{1}{4}\lambda$. When utilizing the proposed method of working media motion with the objective of maximum possible increase of the resistance the value of the characteristic diameter in the characteristic section of the restricted space will be calculated by the formula: $d_1=n\times\lambda+\frac{3}{4}\lambda$. When utilizing the proposed method of working media motion aiming at maximum possible decrease of the flow turbulence level, the characteristic diameter in the characteristic section of the restricted space will be calculated by the formula: $d_1=n\times\lambda$, where $d_1$—characteristic diameter of the restricted space; $n=[d/\lambda]$—a whole number with the fractional remainder neglected; d—required characteristic diameter of the restricted space, calculated by the required working media flow rate; λ—the motioned working media wavelength.

29 Claims, 6 Drawing Sheets

METHOD OF DETERMINING WORKING MEDIA MOTION AND DESIGNING FLOW STRUCTURES FOR SAME

This application is a continuation-in-part of U.S. patent application Ser. No. 08/144,776 filed Oct. 28, 1993 now abandoned.

FIELD OF THE ART

The present invention is directed to techniques for optimizing the flow of various working media, e.g., gaseous or liquid fluids, in various restricted spaces, e.g., in piping or in conduits of any configuration as well as in spaces of irregular and compound section. This technology can be successfully utilized in the design and use of various flow systems.

BACKGROUND OF THE INVENTION

When one considers the conveniences and necessities of everyday life, it is amazing to note the role played by fluid flow structures, such as conduits. For example, all the water used in homes is pumped through pipes so that it will be available when and where it is needed. In addition, virtually all of this water leaves the homes as dilute waste through sewers, another type of conduit. In addition to domestic use, the consumption of water by industry is enormous, including the processing of agricultural products and the manufacturing of durable goods such as steel and paper, to cite a few examples. All the water used in these manufacturing processes is transported by means of piping systems; the petroleum industry in the United States alone transports tens of millions of barrels of liquid petroleum every day in addition to billions of cubic feet of gas transported through pipelines.

In the foregoing examples, it is the transportation of the fluid that is the primary objective. However, there are numerous applications in which flow is a necessary but secondary part of the process. For example, heating and ventilating systems, as well as electric generating stations, utilize conduit flow to circulate fluids to transport energy from one location to another. Piping systems are also used extensively for controlling the operation of machinery.

Presently, the energy associated with a working media under flow, such as a flowing gas or liquid, is typically described by the Bernoulli equation:

$$e = z + \frac{p}{\rho g} + \frac{v^2}{2g} + h_w \tag{1}$$

where e—specific energy of the flow, z—p/ρg—specific potential energy, z—position energy, p/ρg—pressure energy, p—hydrostatic pressure, ρ—density of the working media, $v^2/2g$—specific kinetic energy of the flow, v—velocity of the working media, g—acceleration due to gravity, $h_w$—energy expended to overcome resistance. (See the book "Hydraulics" by Bolshakov V. A., Popov V. N., Kiev Lead Publishers, 1989, p. 63.)

The energy to overcome resistance ($h_w$) during the movement of the working media is typically wasted energy, i.e., mechanical energy that will be transformed into thermal energy. Therefore, it would be useful to reduce the wasted energy required for the transport of the working media, i.e., to minimize the value of $h_w$.

The equation (1) obtained in 1738 by Academician D. Bernoulli of the Russian Academy of Sciences is still the principal equation of hydrodynamics. As a classical representative of Newtonian mechanics, using the mechanism of averaging the hydrodynamic parameters in the turbulent chaos of flow, it is still considered sufficient for the description of physical laws for the movement of fluid substances in various technical appliances. The Bernoulli equation denoting mathematically the law of energy preservation corresponds to the macroscopic level for the description of physical processes of fluid working media transport.

The investigations carried out within the last thirty years in the field of turbulence have shown a high level of organization of flows. The micromovements in the turbulent chaos appear to be so determined that it raises the question of the suitability of statistical averaging methods of the total ensemble of movements, taken as a whole.

Some traditional ideas taken as a basis for numerous technical implementations have already been reconsidered, for instance, the hypothesis of the existence of viscous substrate during the motion of the working media in which the roughness of the wall of the ducts will be diminished. (See Cantwell B. J., organized Motion In Turbulent Flow. Ann. Rew. Fluid Mech. 1981, V.13 pp. 457–515 or the selection of articles entitled "Mechanics". Vortexes and Waves" Edited by Nikolayevsky V. N., Moscow, "Mir" ("Peace"), 1984 p.6).

Presently, there are substances, including fluid helium and various metallic substances, known as super-fluids. The difference between the super-fluid system and the routine working media is the ability of the super-fluid (when the temperature is reduced below a certain temperature of transition) to dramatically change the microscopic features of flow and obtain the capability of flowing without encountering any visible resistance, i.e., there is no waste of energy for the transport of these super-fluids. (See Putterman S. J. Superfluid hydrodynamics. North-Holland Publishing Company, 1974 or Putterman S. Superfluid hydrodynamics. Moscow: Mir (Peace), 1978 p. 79).

In connection with known resistance relationships regarding the motion of fluid working substances in a pipe, FIG. 1 shows the relationship between the resistance coefficient, $C_f$, and the Reynolds number $$Re = \frac{V \cdot d}{v};$$

where V—working substance velocity, d—characteristic diameter of the restricted space through which the working substance will move, v—kinematic viscosity) under different values of relative roughness of an interior pipe surface $\overline{K}_s = k_s/r$ (the relative roughness reflects the degree of elevation of surface irregularities $K_s$ with regards to the piping radius r).

This working media motion resistance relationship was obtained by Nikuradze on the basis of wide regular measurements of various parameters in rough pipes (See Nikuradze J., Stromungsgesetze in rauhen Rohren. Forsch. Arb. Ing.-Wes., VDI, N361 (1933); as well as Schlichting G. Marginal Layer Theory, Moscow: Naura (Science) Main Physical and Mathematical Literature Editorial, 1969, p. 574).

Nikuradse used for his experiments round pipes wherein the inner walls were covered with a layer of sand with the sand grains of certain size. Using the selection of pipes of different radii (r) and different sizes of sand grains $K_s$, the relative roughness $\overline{K}_s$ was varied within the range of 1/500 to 1/15.

Using the results of Nikuradse's measurements, it is possible to calculate the resistance of a rough plate by the calculation method proposed by Prandtl and Schlichting (See Prandtl L., Schlichting H., Dfs Widerstandsgegesetz rauhen pletten. Werft, Reederei, Hafen 1–4 (1934); as well as Schlichting G., Marginal Layer Theory Moscow: Nauka (Science) Main Physical and Mathematical Literature Editorial, 1969, p. 606).

The generalized formula of the resistance relationship for the motion of fluid working media with regards to a solid surface under the known methods of the working media transport is as follows:

$$C_f=f(Re;\bar{K}_s) \quad (2)$$

where $C_f$—specific resistance to the motion of the working media in the restricted space;

Re—Reynolds number;

$\bar{K}_s$—relative roughness.

The main inference of the resistance relationship for rough pipes, presented on the Nikuradse diagram (FIG. 1) and the generalizing formula (2) is that a minimal level of hydraulic resistance, corresponding to the background level of energy dissipation, is obtained by utilizing a surface with a minimal level of roughness.

Thus, provided we would like to have minimal energy loss during the transport of the working media it will be necessary to reduce the resistance, and this will be possible based on the known theory of working media transport only when using surfaces having a minimal roughness level. Therefore, it is necessary to provide surfaces with high smoothness which is practically impossible or which will result in substantial expenditures for the production of such surfaces. In practice, the surfaces with medium level of roughness are typically employed, resulting in energy losses which require, for instance, the use of powerful pumps for liquids and powerful compressors for gasses.

Thus, it would be advantageous to be able to optimize the transport of various working media. It would be advantageous to optimize the transport of working media without relying solely on increasing or decreasing the conduit surface roughness. It would be advantageous to optimize the transport of fluids, such as liquids and gases, through conduits such as pipes, ducts, open channels, valves, pumps, etc. It would be advantageous to optimize the flow of working media such that the resistance to flow is minimized. It would be advantageous to optimize the flow of working media such that the resistance to flow is maximized. It would be advantageous to optimize the transport of working media such that turbulent mixing of separate working media is minimized within a flow structure.

SUMMARY OF THE INVENTION

Figure 1:
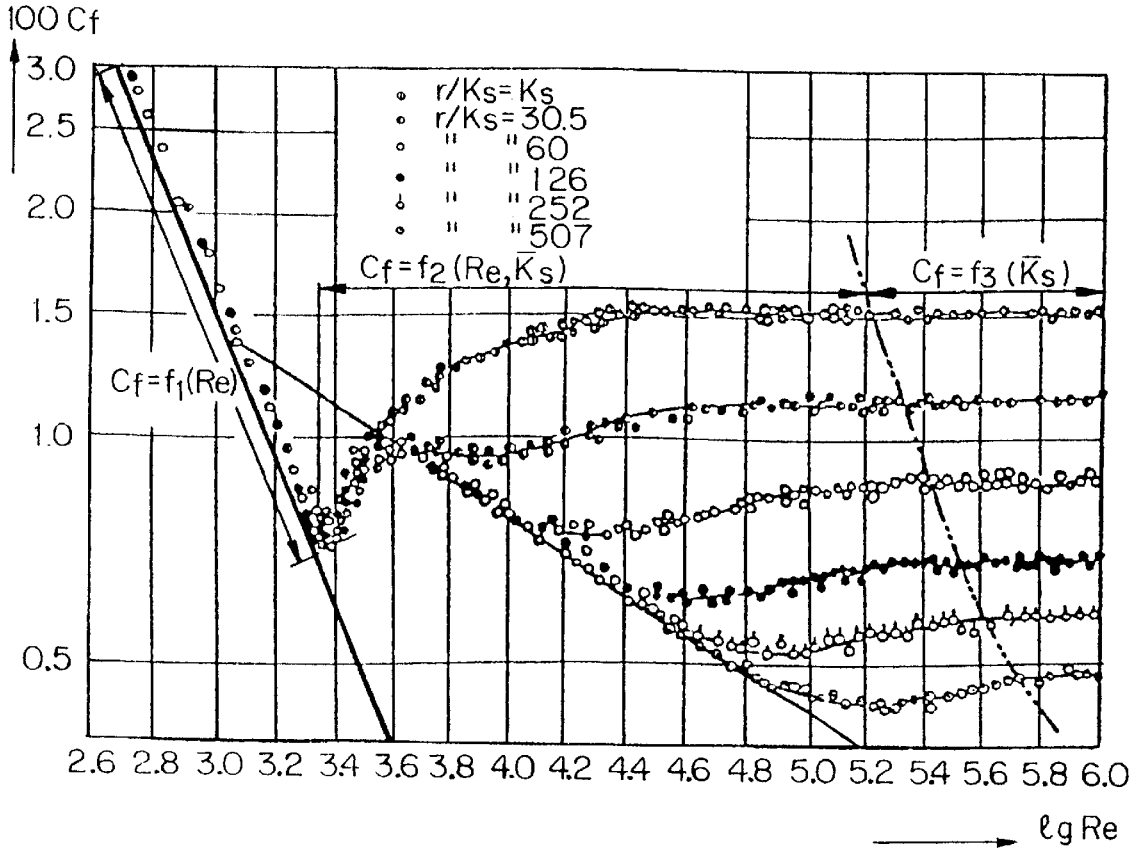
FIG. 1 is a Nikuradse diagram showing the relationship between the coefficient of friction $C_f$ and the Reynolds number Re.

In accordance with the present invention, a process is provided for determining an appropriate characteristic diameter (or equivalent diameter) of a working media flow structure. Initially, an approximate characteristic diameter is determined. This characteristic diameter can be based of design parameters such as fluid flow rates, fluid velocity, maximum and minimum sizes of the flow structure due to space or material limitations, etc. Next, tests are conducted by varying the characteristic diameter slightly, increasing and/or decreasing the characteristic diameters in small increments, as desired. In this manner, a local maximum and a local minimum working media flow rate can be determined. Then, depending on whether a maximum or minimum flow rate is desired, the appropriate diameter is selected. Alternatively, a diameter may be selected which provides a minimum of mixing.

The present invention is based on the unexpected discovery that the resistance to flow in a flow structure varies in a pseudo-sinusoidal manner characteristic of a wave property. In the past, flow rates have typically been increased by either: (1) reducing the coefficient of resistance of the interior of the flow structure by smoothing the interior walls; or (2) substantially increasing the size of the flow structure in order to permit a higher flow rate. While both of these practices still have applicability in connection with the present invention, a third factor is introduced. That is, the resistance to flow provided by a flow structure will increase to a maximum and then decrease to a minimum on a periodic and repeating basis, similar to a sinusoidal curve. This discovery can be exploited in a number of ways. For example, when the approximate characteristic diameter of a desired flow structure is determined, this characteristic diameter may be varied slightly in order to determine the relative maximum and minimum nearest to the desired characteristic diameter (i.e., the "local maximum" and the "local minimum"). In this way, if a maximum flow rate is desired, the characteristic diameter exhibiting the least resistance to flow would be employed. On the other hand, if a minimum flow rate is desired, the characteristic diameter having the maximum resistance to flow would be employed.

As used herein, the term "characteristic diameter" has the same meaning as when used in connection with the calculation of a Reynolds number. For example, for a pipe having a uniform, circular cross-section, the characteristic diameter is the diameter of the pipe. For a non-circular conduit, a characteristic diameter is typically calculated as equal to 4A/P where A is equal to the cross-sectional area and P is equal to the wetted perimeter. (The ratio of cross-sectional area A to the wetted perimeter is typically denoted as the "hydraulic radius" R. Therefore, characteristic diameter equals the diameter of a circular pipe of uniform cross-section and 4R in a non-circular conduit.) In an open conduit, the wetted perimeter is equal to the perimeter of the channel that is actually in contact with the flowing fluid. In other words, for a channel having width W and depth D, the wetted perimeter will be W+2D and the hydraulic radius, R=A/P =WD/(W+2D)' and the characteristic diameter equals 4R. One skilled in the art can calculate the characteristic diameter for other non-uniform flow structures in manners consistent with the above and the teachings of the prior art.

In accordance with a preferred embodiment of the present invention, the wavelength of the moving working media is determined. Maximum and minimum flow rates can then be calculated using the wavelength. One way in which to calculate the wavelength is as follows: (1) provide a flow structure having a characteristic diameter; (2) flow a working media through the flow structure; (3) vary the characteristic diameter of the flow structure slightly, preferably less than 0.1 millimeter and more preferably, less than 0.05 millimeter; (4) flow the same working media through the flow structure with the new characteristic diameter at the same pressure; (5) repeat this experiment and make a plot of characteristic diameter versus velocity of the working media. The plot of these experimental points should approximate a sine curve with the wavelength being measured in a standard manner, e.g., determining the distance between two points of corresponding phase in consecutive cycles. Alternatively, once enough empirical data is collected, wavelength can be calculated directly without resorting to experimentation.

As will be appreciated, one can employ the discovery of the present invention to determine the appropriate characteristic diameter for flow structures for a wide variety of applications. For example, when maximum flow rate is desired, the appropriate characteristic diameter will be that which corresponds to the least resistance to flow. On the other hand, if a minimal flow rate is desired, the characteristic diameter corresponding to the greatest resistance to flow will be selected. Additionally, if the least amount of turbulent mixing is desired, then the appropriate characteristic diameter will be located halfway between the characteristic diameter for the local minimum flow rate and the characteristic diameter for the local maximum flow rate. This also corresponds to a characteristic diameter which is an integer multiple of the wavelength, as discussed in more detail below.

As used herein, the term "working media" indicates any material transported by flow in a flow structure. Examples of working media include fluids such as water, liquid petroleum, etc., gases, such as air, gasified hydrocarbons, etc.; flowable solids such as powders, etc., and mixtures such as solids suspended a liquid (e.g., sewage), liquids suspended in a gas (e.g., aerosols), gas suspended in a solid (e.g., foams), etc. It is also believed that the present invention is applicable to electromagnetic radiation, such as the flow of radiation through a fiber optic cable.

In accordance with another embodiment of the invention, methods are disclosed for using the flow structures designed in accordance with the methods of the present invention. For example, working media is transported through a flow structure designed in accordance with the present invention. A specific example would be determining an appropriate characteristic diameter for a uniform cross-section pipe and flowing a liquid or a gas through such pipe.

In accordance with another embodiment of the present invention, existing flow structures are fitted with inserts wherein the characteristic diameter of the insert is calculated using the methods of the present invention. For example, it is common practice to line existing pipes with an insert in order to prevent leakage in such pipes. This is typically done where it is easier to increase the useful life of the pipe by adding an insert rather than digging up and replacing the pipe. However, a problem that is typically encountered is that the flow rate is decreased due to the decrease of the inner diameter of the pipe. Using the method of the present invention, the diameter of the insert can be calculated in order to obtain an insert diameter which provides the desired flow rate (typically a maximum flow rate is desired). In this embodiment of the present invention, the diameter of the existing pipe is first determined. Next, the minimum thickness of the insert is determined. Then, the appropriate characteristic diameter is determined by continuing to decrease the diameter of the insert/pipe combination until a local maximum is achieved for the velocity of flow. This is then selected as a characteristic diameter of the insert/pipe combination.

DETAILED DESCRIPTION OF THE INVENTION

The basis of the present invention is the development of a method for optimizing working media transport in a restricted space, e.g., in conduits it is possible to reduce the resistance and the energy losses without reducing the roughness of the walls (as is typically implemented in the known methods), but instead by selection of the appropriate characteristic diameter of the conduit.

Alternatively, when desired, the realization of the present method will allow resistance of the moving stream of the working media to be increased to a maximum which will result in the increase of operational effectiveness of various devices designed to reduce flow in a stream.

Additionally, realization of the present method makes it possible to minimize the level of turbulence of the working media stream. This will also increase the effectiveness of providing the desired flow structures.

The inventors have discovered various practical embodiments of their invention. They also believe that they have discovered the theoretical basis for their invention. However, it is to be expressly understood that the inventors will not be bound by the theoretical discussion which follows, but rather that it is offered to aid in the understanding of the invention.

The present invention is directed to a method of optimizing working media transport in a restricted space. In accordance with the invention, prior to the transport of the working media (e.g., solid, electromagnetic, liquid or gaseous) the length of its wave can be calculated, after which the working media will be supplied into a restricted space, whose characteristic diameter in specific sections shall be defined depending on the wavelength of the moving working media. Depending on the task set, the characteristic diameter can be calculated by one of the following formulae:

$$d_1 = n \times \lambda + \tfrac{1}{4}\lambda, \quad (3)$$

$$d_1 = n \times \lambda + \tfrac{3}{4}\lambda, \quad (4)$$

$$d_1 = n \times \lambda, \quad (5)$$

where $d_1$—characteristic diameter of the restricted space;

$n=[d/\lambda]$—a whole number, where the fractional remainder is neglected;

d—desired restricted space characteristic diameter, e.g., calculated by the desired flow rate of the working media; and $\lambda$—working media wavelength.

The characteristic diameter is a particular linear dimension of the flow structure, measured in length values (meter, centimeter, millimeter). In round pipes the characteristic diameter is the pipe diameter. In square sections, the characteristic diameter is 4A/P.

Formula (3) will be utilized when the present method is employed to achieve the maximum possible reduction of resistance while transporting the working media.

Formula (4) will be utilized when the present method is employed to achieve the maximum possible increase of resistance while transporting the working media. This formula (4) is practicable when developing and operating of various packings, couplings and other devices designed to restrict the movement of working media.

Formula (5) will be utilized for designing and operation of flow structures (e.g., hydraulic or aerodynamic systems) which require the maximum possible reduction of the stream turbulence level, e.g., for the purpose of preventing the mixture of various working media.

While not wishing to be bound by any theory, the inventors believe that the present invention is based on the wave nature of working media. Modern physics rests on the idea of the wave nature of substances. The wave nature of a substance will be displayed in that every particle possesses the qualities of a wave and, vice versa, waves have the features characteristic of particles.

Einstein was the first to express this approach in 1905 with his description of the photoeffect. The photoeffect, the Kompton effect as well as the results of other experiments have confirmed that the light behaves as if it consisted of particles with the energy of $E=h\times f$ and impulse $p=h/\lambda$, (where h—Planck constant, f—frequency and $\lambda$—wavelength).

In 1924 Luis de Broil expressed a supposition that the formulas are true not only for photons but for all particles as well. De Broil stated that a pack of particles of any sort, when passing through a double slot, will create an interference pattern. At that time Luis de Broil's hypothesis seemed incredible, yet three years later in 1927 an experiment confirmed the expressed supposition, i.e., that electrons possessed wave features.

Thus it may be deduced that it could be defined for any particles, including atoms and molecules, their energy and impulse from the de Broil's ratios:

$$E=h\times f$$

$$p=h/\lambda.$$

In the experiments with light the principal characteristic value, i.e., the wavelength is typically measured by interferometers according to known methods (see Physical Encyclopedia. Main Editorial A. M. Prokhorov—Moscow; Soviet Encyclopedia, Vol. 2 D–M 1990 p. 770). A screen is installed at some distance from a double slot. The light, after passing through the slots, can be seen on the screen as an interference pattern. The distances between the maximums or minimums of intensity serve as the basis for calculating the wavelength of the passing light.

However, unlike experiments with light, investigations of fluids allow the measurement of principal values— pressure P and velocity V, brought to a mean value by the section of a conduit. It is possible using indirect investigation methods to detect the wave nature of fluid working media motion by altering the geometrical parameters of the streams.

FIG. 2 shows the macro and micro level of the kinematic picture of the fluid flow in the duct for the longitudinal section of the flow along the coordinates X, Z. For illustration, the transported working media will be considered an ideal fluid and its interaction with the walls of the duct won't be taken into account.

Figure 2A:
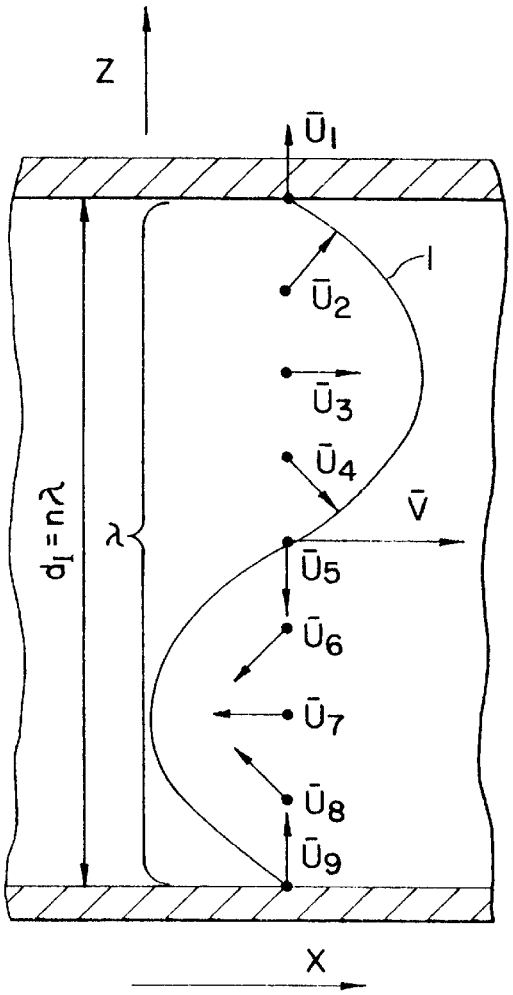
FIG. 2*a* is an illustration of a section of a pipe having diameter $d_1=n\lambda$ with a graphical representation of the theoretical wave character superimposed thereon.

FIG. 2*a* shows the longitudinal section of the duct with the vector presentation of macro and micro level velocities of the working media motion.

Figure 2B:
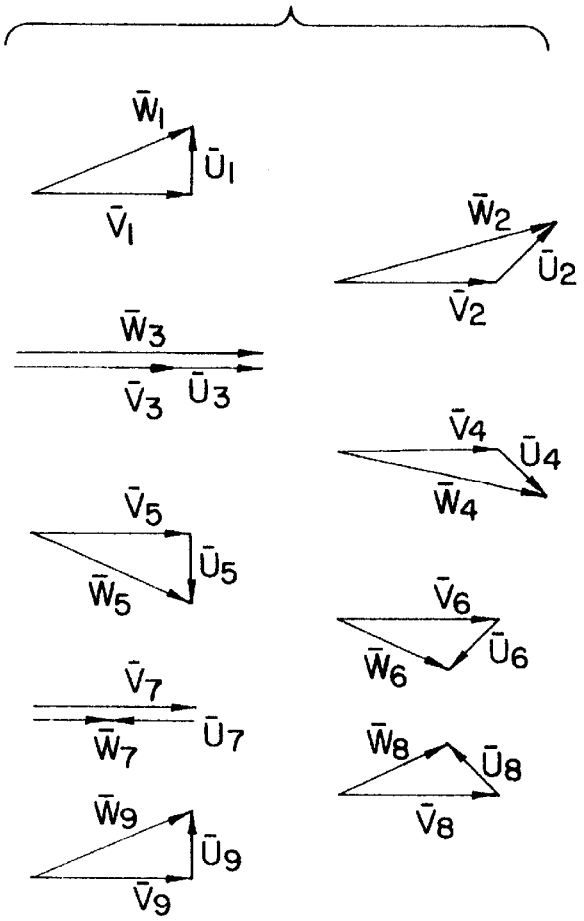
FIG. 2*b* shows a graphical representation of the alignment of the vectors representing real velocity $\overline{W}$, average velocity $\overline{V}$ and component pulsation velocity $\overline{U}$ for a pipe.

FIG. 2*b* shows the alignment of vectors for macro and micro levels of working media motion along the longitudinal section line (along the Z axis) for points 1–9.

The motion of the working media, e.g., fluid in the duct in accordance with the classical approaches might be characterized by the mean (average) velocity $\overline{V}$ along the section of the duct.

It is known that at any point the transported working media stream velocity will continuously change in magnitude value as well in by direction. (See Schlichting G. Marginal Layer Theory. Moscow: Nauka (Science) Main physical and mathematical literature Editorial 1969, p. 452 as well as Bolshakov V. A., Popov V. N. Hydraulics, Kiev. Higher School Lead Publishers, 1989 p. 91). The change over time of the material point instantaneous velocity projection for any direction is called velocity pulsation. The same will be defined by the component pulsation velocity of the material point $\overline{U}$, presenting the difference of the resulting (real) velocity $\overline{W}$ and average velocity $\overline{V}$ (group velocity). FIGS. 2*a*; 3*a*, 3*b*, 3*c*; 4*a*, 4*b* present sinusoidal curves 1 along the longitudinal section line of the duct (Z axis) showing the change of the value of the pulsation component velocity projection $\overline{U}$ onto the direction of the working media motion (X axis). There can be vividly seen the wave (sinusoidal) manner of changing the value of pulsation component velocity projection $\overline{U}$ onto the direction of the working media motion group velocity $\overline{V}$.

In real flows the values of the working media motioning stream velocity seem to be chaotic. Nevertheless investigations carried out by the present inventors have shown that the motion of the working media in the duct has an organized (determined) structure, i.e., the motion of the working media in a restricted space will have the wave nature.

The indirect hydraulic investigations allowed to obtain the wave dependence of the principal energetic parameters under the linear change of geometric dimensions of hydraulic ducts.

Thus, the experiment once again confirmed that the moving fluid will be characterized not only by the classical laws of motion, described by the Bernoulli equation, but also in accordance with the Luis de Broil theory, the flow of material points of fluid according to the wave nature of the substance possesses an inner dynamic energy (wave field) and may be described according to the microlevel laws.

The field is considered not as the type of movement of any environment but as a specific form of matter possessing quite unusual qualities. Unlike particles, the field will continuously be generated and destroyed (i.e., emanated and absorbed by charges) and will possess infinite number of degrees of freedom and will not be localized in certain points of space/time but may spread in the same transmitting the signal (interaction) from one particle to another with the final velocity not exceeding the velocity of light. (See Physical Encyclopedia. Ch. Editor A.M. Prokhorov-Moscow; Soviet Encyclopedia. Vol. 2D–M, 1990. p. 300).

Thus the velocity of the working media motion according to classical approaches can be characterized by the average velocity $\overline{V}$ and by the pulsation component of the velocity of the flow material point movement $\overline{U}$. The vector association of the average velocity $\overline{V}$ and velocity component $\overline{U}$ will provide the kinematic picture of fluid environments movement in the duct (FIG. 2*b*). The first turbulence theory proposed in 1895 by Osborn Reinolds, (See Bolshakov V. A., Popov V. N. Hydraulics. Kiev. Higher school. Main Publishers, 1989, p. 91) presents all the parameters of the flow exactly in such form, i.e., as a sum of two parts: average $\overline{V}$ and pulsation $\overline{U}$.

The resulting real velocity of the flow of each material point (molecule) $\overline{W}$ will be equal to the vector sum of the average velocity $\overline{V}$ and pulsation component of the velocity $\overline{U}$.

$$\overline{W}=\overline{V}+\overline{U}$$

In a rectangular duct it was discovered that the motioning flow in a duct with a given depth and a given width has a certain level of inner dynamic energy presented as a wave field characteristic of the particles of the motioning environment. This wave field at the same time being restricted by the margins of the flow, average velocity $\overline{V}$ will characterize the group velocity of the flow and the pulsation component of the velocity $\overline{U}$ in the space of the flow having the periodical sinusoidal feature. The space wave period, i.e., the distance between the two nearest points of the wave process staying in the same fluctuation phase will define the characteristic value of microlevel—the wavelength λ (FIGS. 2*a*; 3*a*, 3*b*, 3*c*,; 4*a*, 4*b*).

Using the known method of wave fields section description, discussing the cutting of the longitudinal duct section according to Guigense principle (see Physical Encyclopedia. Ch. Editor AM. Prokhorov—Moscow: Soviet Encyclopedia. Vol. 1 A–D, 1990, p. 547) each material point may be presented as the point source of the wave front. The spreading of the wave front will be characterized by the motion of the wave front surface in each point of which at the present moment of time the wave has a similar phase. Many wave front sources in the space of the duct create a summary field with the alternate intensity in different points. An interference pattern of wave fronts will appear in the duct of all sources, i.e., mutual increase or decrease of two (or more numbers) of waves when interfering of the same on each other while simultaneous spreading in the space (see Physical Encyclopedia. Ch. Editor AM. Prokhorov—Moscow; Soviet Encyclopedia, Vol. 2 D–M, 1990. p. 162).

The wave fronts cancel each other when the difference between the wave phases amounts to 180 degrees, i.e., when the wave fronts cancel each other the difference between each amounts to half of the wavelength λ/2.

As it may be seen from FIG. 2*a* there is a multiple wavelength number located in the longitudinal section of the duct along the selected coordinate Z, i.e., the characteristic diameters of the duct were selected so, that $$d_1=n\times\lambda$$

where n=[d/λ]—a whole number, where the fractional remainder is neglected, equal to the quantity of whole wavelengths λ located in the longitudinal section of the duct.

The wave fronts of the field of the inner dynamic energy of the working media flow the phase difference between which is equal to λ/2 (See FIG. 2 point.1 and p.5; p.2 and p.6; p.3 and p.7; p.4 and p.8) cancel each other. In this case we may speak about the background interference phenomena along the entire section of the duct.

Analyzing the kinematic picture in FIG. 2 it may be deduced as follows. The real velocities $W_1$ at the upper (see FIG. 2*b*; point 1) and lower $W_9$ (FIG. 2*b*; point 9) walls will be practically equal to the averaged (group) velocity $\overline{V}$ of the working media flow, i.e., in case when in the longitudinal section of the duct along the selected coordinate the multiple number of wavelengths will be represented n×λ, the contribution of pulsation components of velocity $\overline{U}$ in the general kinematic picture will equal to zero. Therefore the flow of the working media in the duct in such kinematic situation has the minimal level of turbulence and appropriately the minimal mixture of layers. (The description of the kinematic situation more vividly explaining this statement will be presented lower, see description, FIG. 3).

When geometrical parameters of the longitudinal section along the selected coordinate deviate from the multiple wavelength value there appear positive or destructive activities of wave front interference between the inner dynamic energy fields.

The difference between the required characteristic diameter d of the longitudinal duct section investigated and the value of the multiple wavelength n×λ of the motioned working media may be called the "Δ-section" and calculated by the formula:

$$\Delta=d-n\times\lambda$$

The "Δ-section" value might be compared with the roughness value $\overline{K}_s$ in Nikuradse's experiments (See Nikuradse J., Stromungsgesetze in rauhen Rohren. Forsch. Arb. Ing.-Wes., -VDI, N 361 (1933) as well as Schlichting G. Marginal Layer Theory. Moscow: Nauka (Science) Main physical and mathematical literature Editorial. 1969, p. 574).

In the area of "Δ-section" the pulsation velocity component $\overline{U}$ either positively or destructively affects the value of the real velocity $\overline{W}$ at the point of working media contact with the wall. For the fixed value of pressure in the duct including different values of "Δ-section" there will be different values of real velocity $\overline{W}$ of the flow at the wall in the "Δ-section" corresponding to the same depending on the contribution of the pulsation speed component $\overline{U}$.

That is, the alteration of the "Δ-section" value will effect the ratio of principal energetic parameters (pressure P and velocity V) of the working media motion in a restricted space.

FIG. 3 shows the kinematic situation in the duct whose characteristic diameter along the Z coordinate differs from the multiple wavelength n×λ by a quarter of a full wavelength period of ¼λ, i.e., Δ=¼λ.

It may be guessed that in this case the solid surface—motioning environment system will tend to the background interference level of wave fronts of inner dynamical energy field. Therefore the inner dynamical energy field of the motioned working media will be located so that the background interference level will stay at one (FIG. 3*a* at the upper wall) then at another surface (FIG. 3*c* —at the lower wall). This must bring to the pulsation of the marginal layer, i.e., to the interchanging of background and non-background interference level at each wall.

At the point of working media contact with the wall the vector of averaged (group) velocity along the duct section is $\overline{V}_w$, the vector of velocity pulsation component is $\overline{U}_w$, the vector of real velocity is $\overline{W}_w$.

Figure 3A:
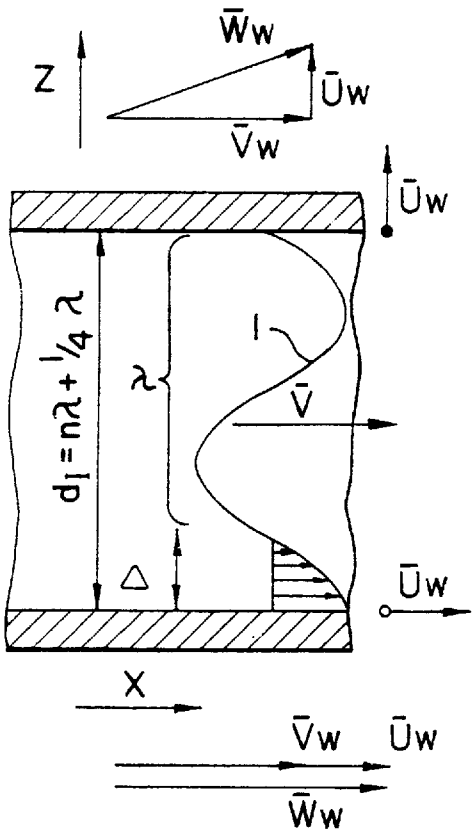
FIGS. 3*a*, 3*b* and 3*c* are illustrations of a section of pipe having diameter $d_1=n\lambda+\frac{1}{4}\lambda$ with a graphical representation of the theoretical wave character and velocity vectors superimposed thereon.

The kinematic situation in FIG. 3*a* presents a picture when the background level of wave fronts interference of the inner dynamic energy field is located at the upper wall. There the wave fronts of interference picture suppress each other (See FIG. 2 and its description).

At the lower wall a part of the longitudinal section "Δ-section" of the duct will be the source of non-background interference pattern affecting the combination of principal energetical values of working media motion (pressure P and velocity V).

The vector kinematic diagram at the lower wall shows that the pulsation component vector $\overline{U}_w$ of the velocity coincides with the vector of the averaged (group) working flow velocity $\overline{V}_w$. Therefore, the real velocity $\overline{W}_w$ at the lower wall for the value of pressure set in the duct will have a maximum value.

The kinematic diagram at the upper wall shows that the real velocity vector $\overline{W}_w$ will be practically equal by the value of the average (group) velocity vector $\overline{V}_w$ of the working flow.

The kinematic situation in FIG. 3*c* presents a reverse picture, set out in FIG. 3*a*. The vector kinematic diagram at the upper wall shows that the velocity pulsation component vector $\overline{U}_w$ coincides with the vector of the averaged (group) speed $\overline{V}_w$ of the working flow. Consequently the real velocity $\overline{W}_w$ at the upper wall for the pressure value set in the duct will have a maximum value.

The kinematic diagram at the lower wall shows that the real velocity vector $\overline{W}_w$ will be practically equal by value to the vector of the averaged (group) velocity $\overline{V}_w$ of the working flow.

Figure 3B:
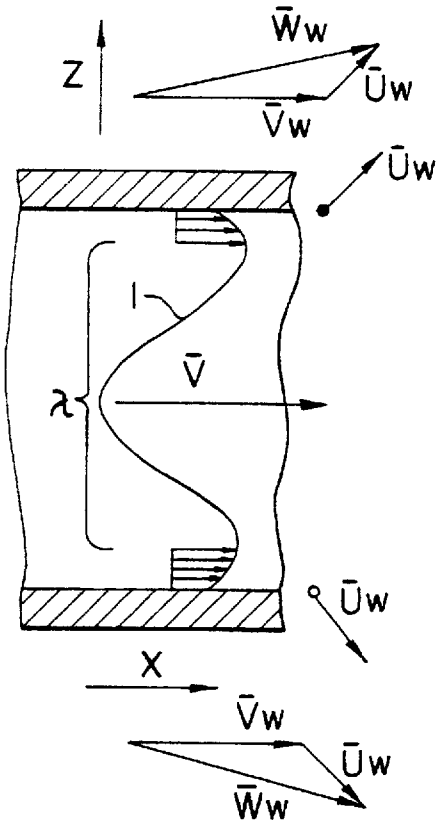
Figure 3C:
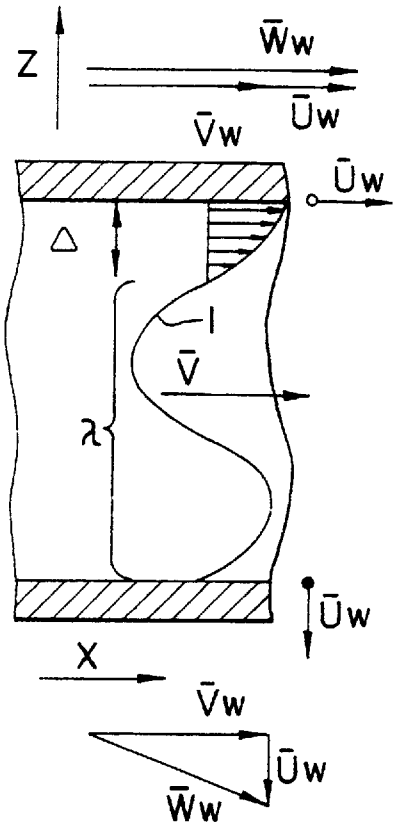

FIG. 3*b* shows a kinematic situation in the working media flow at the moment of the background picture of dynamic energy field passing from one wall to another. It may be guessed that within a short period of time a part of longitudinal section could be singled out from each of the walls the same section generating the interference picture of the dynamic energy field which differs from the background level. Likewise, as the value of the non-background area will increase at one wall, it will decrease by the same value at the other wall. The summarized characteristic diameter of non-background areas will remain constant. The average value of real velocities at the wall shall be calculated by the ratio:

$$W_{av.w} = \frac{W_{w.1} + W_{w.2}}{2}$$

where $W_{av.w}$—averaged value of real velocities at the upper and lower walls of the duct;

$W_{w.1}$—real velocity at the upper wall;

$W_{w.2}$—real velocity at the lower wall. This value will have a constant value.

At the moment of passing of the background level of the dynamic energy field interference picture of the working media flow from one wall to another the vectors of pulsation component in each point along the entire section of the duct will perform a turn. In the section of the duct, presented in FIG. 3 the turn of the speed pulsation component vectors will amount to ¼ of the full wave process period or to 90 degrees. Visually it could be followed by the vector velocity diagrams, reflecting the kinematic situation in the points of contact of the working media flow with the upper and lower walls of the duct in FIGS. 3*a*, 3*b*, 3*c*; 4*a*, 4*b*. While in the section of the duct, set out in FIG. 2 the turn-angle of the speed pulsation components vectors will be equal to zero. Visually it could be followed by FIG. 2*b*.

To obtain a hydraulic duct with a minimal resistance level, i.e., a duct in which for the set value of pressure it is possible to obtain a maximum velocity value, it is necessary to provide the characteristic diameter of the characteristic section $d_1$, bigger than the multiple wavelength value $n\times\lambda$ by a quarter of the full wave ¼λ, namely:

$$d_1 = n\times\lambda + \tfrac{1}{4}\lambda \quad (3)$$

FIG. 3 presents a graphical picture of this case. At the same time at the upper wall in FIG. 3*a* and the lower wall in FIG. 3*c* it is possible to register the background level of the inner dynamic energy field where the real velocity $\overline{W}_w$ will practically be equal to the mean (average) (group) velocity $\overline{V}_w$.

At the lower wall in FIG. 3*a* and the upper wall in FIG. 3*c* the averaged velocity $\overline{V}_w$ and the velocity pulsation component $\overline{U}_w$ will coincide in direction, consequently the real velocity $\overline{W}_w$ will have a maximum value and resistance a minimal value.

This has been confirmed by the experimental tests the results of which are presented in the diagram (see FIG. 5) of dependence of the resistance value of the modeling device $C_f l/R$ on the flow mode of the working media (Reynolds number, Re) under different values of the characteristic diameters of the duct $d_1$ (in the tests presented herewith it means the change of the duct depth D).

In this case as the decisive dimension in the Reynolds number, the value $$R = \frac{W \cdot D}{2(W + D)}$$

(hydraulic radius) is utilized, and in the other case $$d_e = \frac{2W \cdot D}{W + D}$$

(characteristic or equivalent diameter) (in the technical fiction both values are used equally, the latter being related by the ratio $d_e$=4R). The change of the duct height was carried out within the ranges comparable with the roughness value in Nikuradse's experiments in addition comparable with the motioning working media wavelength value.

Figure 5A:
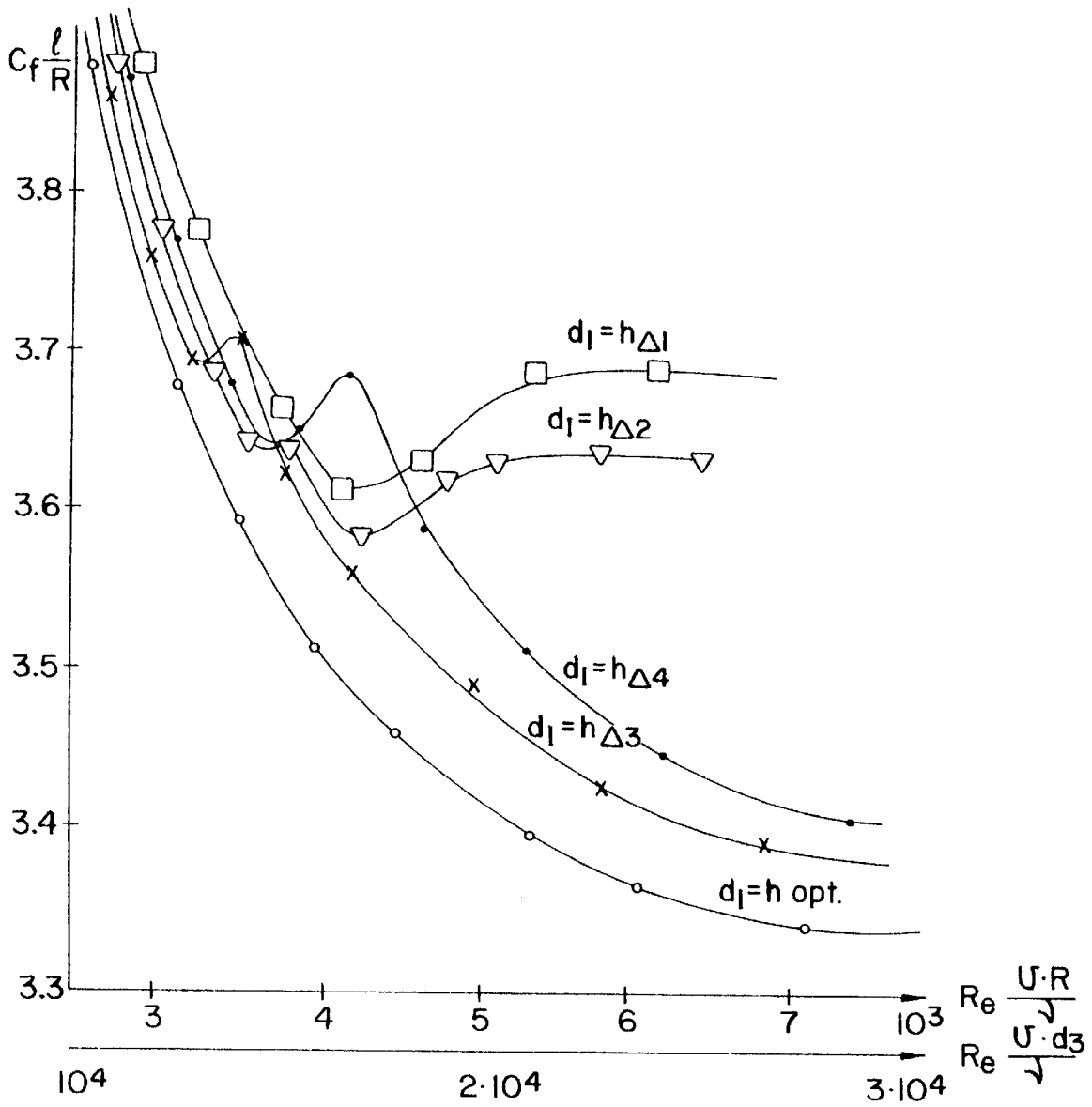
FIGS. 5*a*, 5*b* and 5*c* show the relationship between the resistance value of the modeling device $C_f l/R$ and the flow mode of the working media (Reynolds number Re).
Figure 5B:
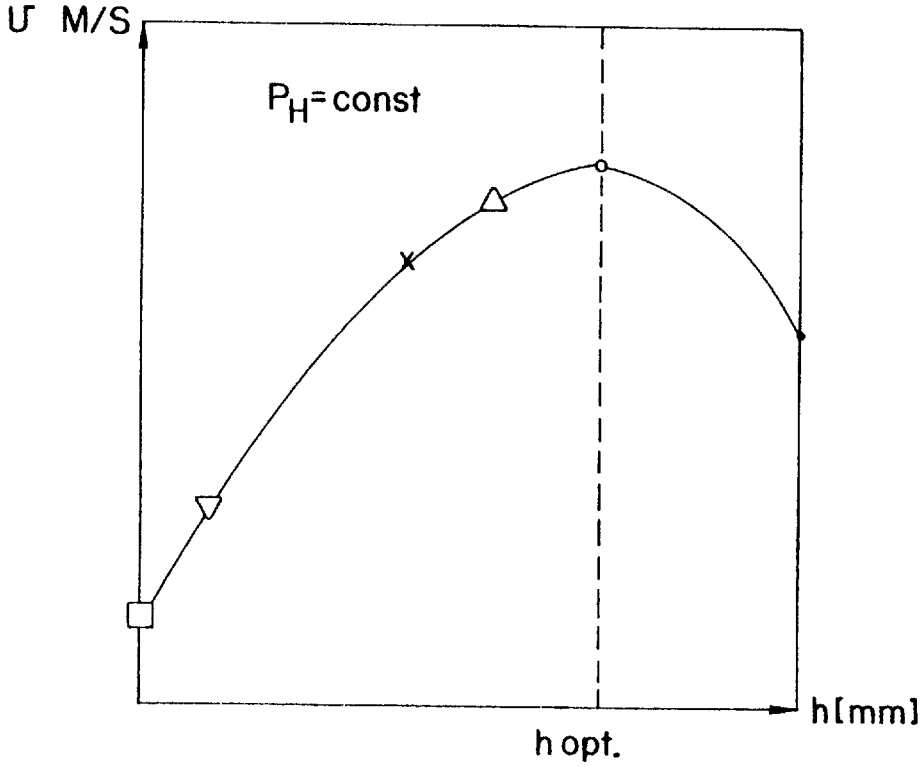
Figure 5C:
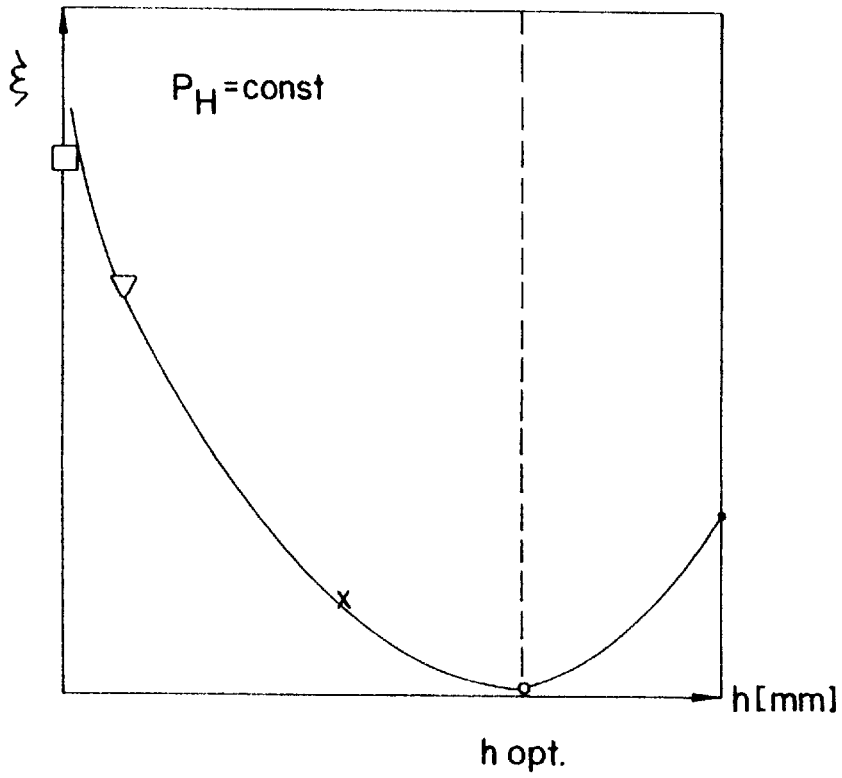

One may see in FIG. 5 that in case when characteristic diameter of the duct $d_1$ amounted to $d_1$=2.21 mm or $d_1 = n\times\lambda + \tfrac{1}{4}\lambda$, the value of resistance to the working media motion in the modeling device $\xi = C_f l/R$ was minimal (see FIG. 5*a*, h optimal curve; FIG. 5*c*, h optimal point). The velocity value being (for registered in all series of tests pressure value $P_H$=7 meter water column) of maximum value (FIG. 5*b* h optimal point).

Thus the characteristic diameters of the duct in case of minimal resistance under working media motion may be calculated by the formula:

$$d_1 = n\times\lambda + \tfrac{1}{4}\lambda \quad (3)$$

where n=[d/λ]—a whole number, where the fractional remainder is neglected.

There exist a great number of technical problems in which it is necessary to obtain the biggest value of resistance under the working media motion, i.e., to have a maximum level of energy dissipation when the pre-set pressure value should correspond to minimal velocity (flow rate). Labyrinth seal ducts are typical examples of these technical applications.

Figure 4A:
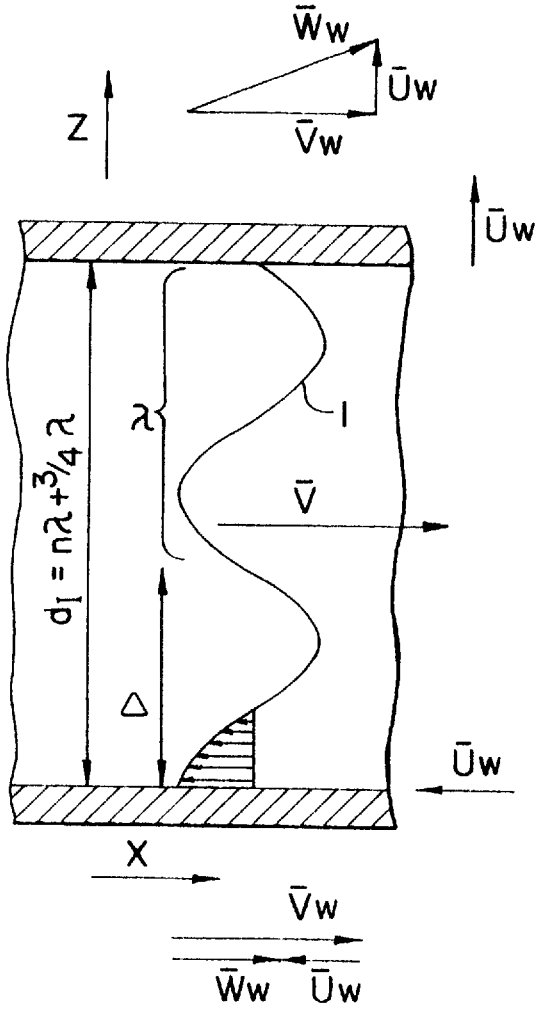
FIGS. 4*a* and 4*b* are illustrations of a section of pipe having diameter $d_1=n\lambda+\frac{3}{4}\lambda$ with a graphical representation of the theoretical wave character and velocity vectors superimposed thereon.
Figure 4B:
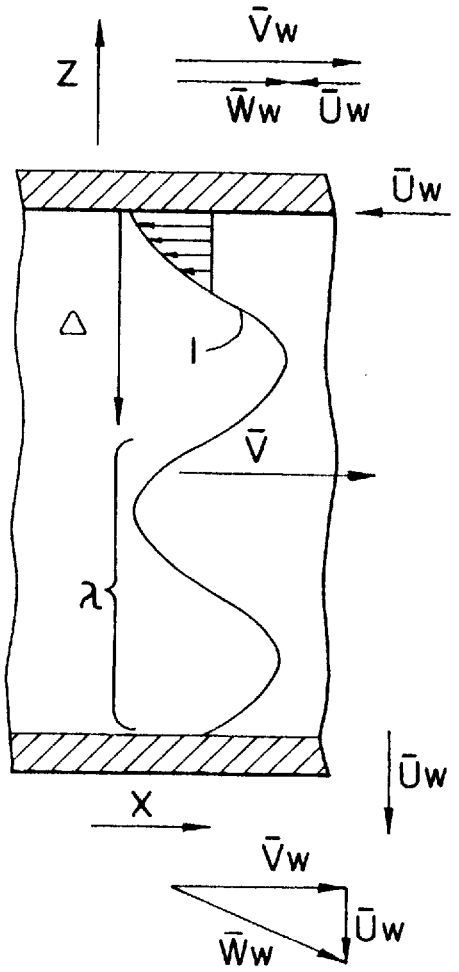

FIG. 4 shows kinematic situation in the duct the characteristic diameter of which $d_1$ along coordinate Z differs from the multiple wavelength value $n\times\lambda$ by three quarters of full wavelength period, i.e., "Δ-section"=¾λ, $d_1 = n\times\lambda + \tfrac{3}{4}\lambda$. In this case at the upper wall in FIG. 4*a* and at the lower wall in FIG. 4*b* it is possible to fix the background level of the inner dynamic energy field, the real velocity $\overline{W}_w$ being practically equal to the average (group) velocity $\overline{V}_w$. At the lower wall in FIG. 4*a* and at the upper wall in FIG. 4*b* the angle between the speed pulsation component $\overline{U}_w$ and the averaged velocity vector $\overline{V}_w$ will amount to 180 degrees (i.e., the vectors of these velocities are directed in opposite directions) consequently the real velocity $\overline{W}_w$ (flow rate) will have a minimal value and the resistance a maximum value.

This has been confirmed by experimental tests. By FIG. 5 it may be seen that in case when characteristic diameter of the duct $d_1$ amounts to $d_1$=h=1.95 mm (to other case $d_1$=h=2.47 mm) or $d_1=h\times\lambda+\frac{3}{4}\lambda$, the value of working media motion resistance in the modeling device $\xi=C_f l/R$ will be maximum (see FIG. 5*a*, $h_{\Delta 1}$ curve; FIG. 5*c*, Δ1 point—□).

Thus characteristic diameters $d_1$ of the duct in case of maximum resistance under working media motion may be calculated by the formula:

$$d_1=n\times\lambda+\tfrac{3}{4}\lambda, \tag{4}$$

where n=[d/λ]—whole number, where the fractional remainder is neglected.

Returning to the kinematical situation, presented in FIG. 2 when characteristic diameter $d_1$ of the duct longitudinal section along the Z coordinate is equal to the multiple wavelength, i.e., $d_1=n\times\lambda$ it could be noted the following. As it has been described above, the wave fronts of the inner dynamic energy flow field will in this situation entirely suppress each other.

The real velocity $\overline{W}$ at the upper and lower walls will practically be equal to the average (group) velocity $\overline{V}$ of the working media flow.

This will exclude the reason for the appearing of the marginal layer pulsation at the walls of the duct. Unavailability of "Δ-section" in the transverse section of the duct will exclude the turn of the velocity pulsation component vectors $\overline{U}$. This will provide the minimum level of turbulence of the flow in the section of the duct and minimum mixture of the motioning working media layers.

Thus the characteristic diameters $d_1$ of the duct in case when a minimal mixture of motioned working media layers is required to be provided may be calculated by:

$$d_1=n\times\lambda, \tag{5}$$

where n=[d/λ]—whole number, where the fractional remainder is neglected.

Analyzing the results of the experimental tests (see FIG. 5) when realizing the proposed method of working media motion, the following may be concluded. Under the motion of the working media, e.g., fluid in the duct with smooth surface changing only the characteristic diameter $d_1$ (and not the roughness, as implemented in the known method) it will be possible to obtain the most part of hydraulic resistances spectrum, which will be practically identical in all the modes to Nikuradse's experimental data (see FIG. 1), obtained when realizing the known method of working media motion.

Consequently to obtain for instance a minimal value of the restricted space resistance (e.g., a duct) it is required to measure the characteristic diameters $d_1$, i.e., its geometrical parameters corresponding to the maximum value of velocity under the required pressure.

Nevertheless returning to the methods of performing classical investigations by Nikuradse (when realizing the known method of working media motion) it should be noted the following. When Nikuradse was covering the surface of the experimental duct with the grains of sand of different size changing thus not only the roughness but the characteristic diameters $d_1$ (diameter) of the duct respectively. In his experiments Nikuradse considered the pipe diameter as a constant value. Coming from this concept Nikuradse built his classical graphical relationships from which he developed under turbulent mode direct relationship of the duct resistance values with regards to the roughness of its surface.

Indeed in real life the use of the sand grains of different caliber resulted in the change of diameter of the experimental pipe. This value being comparable with the change of the characteristic diameters $d_1$ of the duct in the tests carried out by the authors. The same changes of the characteristic diameters $d_1$ having been calculated depending on the wavelength of the motioned working media.

Thus it should be stressed once again that when realizing the proposed method of the working media motion it will seem possible for instance to decrease the duct resistance value only by changing its characteristic diameter $d_1$ the value of this changing being comparable with the duct roughness value. In case of realization of the known method however (after Nikuradse for instance) to achieve the same duct resistance value it will be necessary to decrease the roughness of the duct and this will require a number of additional technological processes and will result in new expenses for equipment and energy.

Thus thorough experimental investigations have confirmed the theoretical incentives that under realization of the proposed method of working media motion it will evidently be possible (as compared to that of the known methods) to decrease the resistance under the working media motion (if required) or increase the same to a maximum possible value (when required) or decrease the turbulence level under the working media motion.

Considering that all this could be realized under minimum energetic and financial expenditures changing only characteristic diameters, e.g., of the piping which will be calculated depending on the wavelength of the working media motioned.

It should be noted that the characteristic diameter change value of the piping is of minor character and is comparable to its roughness value.

The table presents some experimental data of the obtained specific resistances under the working media motion (water) in similar conditions of a restricted space, e.g., in the piping under realization of the known and proposed methods of working media motion.

| Reynolds Number Re | Known method (after Nikuradse) $C_f=\frac{0.3164}{4\cdot Re^{0.25}}$ Specific resistance to the motion of the working media in the restricted space $C_f$ | Proposed method $d_1$ = 2.21 mm $d_1=n\times\lambda+\frac{1}{4}\lambda$ $C_f$ | Proposed method $d_1$ = 2.47 mm $d_1=n\times\lambda+\frac{3}{4}\lambda$ $C_f$ |
|---|---|---|---|
| 12,000 | 0.0075 | 0.0066 | 0.0085 |
| 20,000 | 0.0066 | 0.0058 | 0.0075 |
| 30,000 | 0.0060 | 0.0053 | 0.0068 |

It may be seen from the above table that the proposed method is more effective than the known method.

Thus, for instance when realizing the proposed method (the diameter of the piping had been calculated according to formula:

$$d_1=n\times\lambda+\tfrac{1}{4}\lambda,\ d_1=2.21\text{ mm})$$

the specific resistance value of the piping amounted to $C_f$=0.0066 at the same time under similar conditions this value (under realization of the known method) amounted to $C_f$=0.0075.

Thus the specific resistance value can be decreased by 12% without any additional expenses.

It may be seen from the above table, when realizing the proposed method (the diameter of the piping had been calculated according to formula:

$$d_1=n\times\lambda+\tfrac{3}{4}\lambda,\ d_1=2.47\ \text{mm})$$

the specific resistance value of the piping amounted to $C_f$=0.0085 at the same time under similar conditions this value (under realization of the known method) amounted to $C_f$=0.0075. Thus, the specific resistance value has been increased by thirteen percent without any additional expenses.

INDUSTRIAL APPLICATION

The proposed method of working media motion may be utilized in the technique of motioning of various working media (e.g., liquid or gaseous) in different restricted spaces, e.g., in pipes and ducts of any configuration as well as of irregular and compound section.

This technology may be successfully implemented, e.g., in various systems in the flow through parts of hydro and turbo machines, when developing various energetic objects their sealing, recording and controlling equipment in which the working media motion will take place.

The foregoing description of the invention has been presented for purposes of illustration and description. Further, the description is not intended to limit the invention to the form disclosed herein. Consequently, variations and modifications commensurate with the above teachings, and the skill or knowledge in the relevant art are within the scope of the present invention. The preferred embodiments described herein is further intended to explain the best mode known of practicing the invention and to enable others skilled in the art to utilize the invention in various embodiments and with various modifications required by their particular applications or uses of the invention. It is intended that the appended claims be construed to include alternate embodiments to the extent permitted by the prior art.

We claim:

1. A method of optimizing working media motion, in a restricted space comprising: measuring the wavelength of a transverse wave of the working media and then directing the working media into a restricted space having a characteristic diameter in a characteristic section calculated using the wavelength of the motioned working media.

2. The method of optimizing working media motion according to claim 1, wherein the characteristic diameter in the characteristic section of the restricted space is calculated by the formula:

$$d_1=n\times\lambda+\tfrac{1}{4}\lambda$$

where $d_1$—characteristic diameter of the restricted space;

n=[d/λ]—a whole number, where the fractional remainder is neglected;

d—desired restricted space characteristic diameter, e.g., calculated using the desired flow rate of the working media;

λ—the working media wavelength of a transverse wave.

3. The method of optimizing working media motion according to claim 1, wherein the characteristic diameter value in the characteristic section of the restricted space is calculated by the formula:

$$d_1=n\times\lambda+\tfrac{3}{4}\lambda$$

where $d_1$—characteristic diameter of the restricted space;

n=[d/λ]—a whole number, where the fractional remainder is neglected;

d—desired restricted space characteristic diameter, e.g., calculated using the desired flow rate of the working media;

λ—the working media wavelength of a transverse wave.

4. The method of optimizing working media motion according to claim 1, wherein the characteristic diameter value in the characteristic section of the restricted space is calculated by the formula:

$$d_1=n\times\lambda$$

where $d_1$—characteristic diameter of the restricted space;

n=[d/λ]—a whole number, where the fractional remainder is neglected;

d—desired restricted space characteristic diameter, e.g., calculated using the desired flow rate of the working media;

λ—the working media wavelength of a transverse wave.

5. A method for determining an appropriate characteristic diameter of a flow structure, comprising the steps of:

a) determining an approximate characteristic diameter based on desired throughput of working media through the flow structure;

b) varying the characteristic diameter of the flow structure incrementally to obtain experimental information concerning the effect of varying the characteristic diameter and to determine a local maximum and a local minimum flow rate;

c) selecting a desired characteristic diameter based on the experimental information.

6. The method, as claimed in claim 5, wherein the increment by which the characteristic diameter is varied is less than 0.1 millimeters.

7. A method, as claimed in claim 5, wherein the experimental information is employed to determine an appropriate flow rate in which a minimum amount of mixing occurs.

8. The method, as claimed in claim 5, wherein the experimental information is employed to determine an appropriate size for an insert for placement within said fluid flow structure.

9. A method for designing a flow structure for use with a working media comprising the steps:

a) determining an approximate characteristic diameter d of the flow structure;

b) determining a wavelength λ of a transverse wave for the working media and the approximate characteristic diameter;

c) producing a flow structure having a characteristic diameter $d_1$ substantially equal to $d_1=n\times\lambda+\tfrac{1}{4}\lambda$, where n is an integer.

10. The method as claimed in claim 9 wherein said characteristic diameter $d_1$ is equal to 4A/P, where A is an area available for flow in the flow structure and P is a wetted perimeter about A.

11. The method as claimed in claim 9 wherein said characteristic diameter is equal to the diameter of a circular pipe having a uniform cross section.

12. The met hod as claimed in claim 9 wherein said wavelength λ of a transverse wave is determined by:

a ) select ing a characteristic diameter;

b) varying said characteristic diameter incrementally in order to determine the effect of changing said characteristic diameter on flow properties of a working media flowing through said flow structure;

c) plotting the characteristic diameter of said flow structure versus the flow properties in order to generate a graphical representation of a periodic wave relationship between said characteristic diameter and said flow properties;

d) determining the distance in said periodic wave between two points of corresponding phase in consecutive cycles to determine said wavelength $\lambda$ of a transverse wave.

13. A method for designing a flow structure for use with a working media comprising the steps:

a) determining an approximate characteristic diameter d of the flow structure;

b) determining a wavelength $\lambda$ of a transverse wave for the working media and the approximate characteristic diameter;

c) producing the flow structure having a characteristic diameter $d_1$ substantially equal to $d_1=n\times\lambda+\frac{3}{4}\lambda$, where n is an integer.

14. The method as claimed in claim 13 wherein said characteristic diameter $d_1$ is equal to 4A/P, where A is an area available for flow in the flow structure and P is a wetted perimeter about A.

15. The method as claimed in claim 13 wherein said characteristic diameter is equal to the diameter of a circular pipe having a uniform cross section.

16. The method as claimed in claim 13 wherein said wavelength $\lambda$ of a transverse wave is determined by:

a) selecting a characteristic diameter;

b) varying said characteristic diameter incrementally in order to determine the effect of changing said characteristic diameter on flow properties of a working media flowing through said flow structure;

c) plotting the characteristic diameter of said flow structure versus the flow properties in order to generate a graphical representation of a periodic wave relationship between said characteristic diameter and said flow properties;

d) determining the distance in said periodic wave between two points of corresponding phase in consecutive cycles to determine said wavelength $\lambda$ of a transverse wave.

17. A method for designing a flow structure for use with a working media comprising the steps:

a) determining an approximate characteristic diameter d of the flow structure;

b) determining a wavelength $\lambda$ of a transverse wave for the working media and the approximate characteristic diameter;

c) producing the flow structure having a characteristic diameter $d_1$ substantially equal to $d_1=n\times\lambda$, where n is an integer.

18. The method as claimed in claim 17 wherein said characteristic diameter is equal to 4A/P, where A is an area available for flow in the flow structure and P is a wetted perimeter about A.

19. The method as claimed in claim 17 wherein said characteristic diameter is equal to the diameter of a circular pipe having a uniform cross section.

20. The method as claimed in claim 17 wherein said wavelength $\lambda$ of a transverse wave is determined by:

a) selecting a characteristic diameter;

b) varying said characteristic diameter incrementally in order to determine the effect of changing said characteristic diameter on flow properties of a working media flowing through said flow structure;

c) plotting the characteristic diameter of said flow structure versus the flow properties in order to generate a graphical representation of a periodic wave relationship between said characteristic diameter and said flow properties;

d) determining the distance in said periodic wave between two points of corresponding phase in consecutive cycles to determine said wavelength $\lambda$ of a transverse wave.

21. A flow structure having a characteristic diameter $d_1$ selected from the group consisting of: $d_1=n\times\lambda+\frac{1}{4}\lambda$; $d_1=n\times\lambda+\frac{3}{4}\lambda$; and $d_1=n\times\lambda$.

22. The flow structure as claimed in claim 21 wherein wavelength $\lambda$ of a transverse wave is determined by:

a) selecting a characteristic diameter;

b) varying said characteristic diameter incrementally in order to determine the effect of changing said characteristic diameter on flow properties of a working media flowing through said flow structure;

c) plotting the characteristic diameter of said flow structure versus the flow properties in order to generate a graphical representation of a periodic wave relationship between said characteristic diameter and said flow properties;

d) determining the distance in said periodic wave between two points of corresponding phase in consecutive cycles to determine said wavelength $\lambda$ of a transverse wave.

23. A flow structure produced by the process described in claim 5.

24. A method for transporting a working media comprising applying pressure to said working media in order to cause said working media to flow through a flow structure produced by the process described in claim 5.

25. A method for manufacturing a flow structure comprising manufacturing a flow structure having a characteristic diameter determined according to claim 5.

26. A method for determining the wavelength of a transverse wave of a working media flowing in a flow structure comprising the steps:

a) selecting a characteristic diameter for said flow structure;

b) varying said characteristic diameter in order to determine a relationship between said characteristic diameter and flow properties of a working media flowing through said flow structure; and c) identifying and employing a periodic variation of said relationship in order to determine a wavelength of a transverse wave of said working media.

27. A flow insert for inserting into an existing flow structure wherein a characteristic diameter of said insert is calculated according to the method described in claim 5.

28. The flow insert as claimed in claim 27, wherein said existing flow structure is a pipe and said flow insert is inserted inside of said pipe.

29. The method of claim 1 wherein said working media is a fluid.

* * * * *